US008092245B2

(12) United States Patent
Morello et al.

(10) Patent No.: US 8,092,245 B2
(45) Date of Patent: Jan. 10, 2012

(54) ELECTRICAL CONNECTOR ASSEMBLY

(75) Inventors: John R. Morello, Warren, OH (US); Charles L. Flask, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 9 days.

(21) Appl. No.: 12/287,774

(22) Filed: Oct. 14, 2008

(65) Prior Publication Data

US 2010/0093204 A1 Apr. 15, 2010

(51) Int. Cl.
*H01R 13/73* (2006.01)

(52) U.S. Cl. ..... 439/352

(58) Field of Classification Search ..... 439/352, 439/358, 357, 356
See application file for complete search history.

(56) References Cited

U.S. PATENT DOCUMENTS

| | | | | |
|---|---|---|---|---|
| 5,096,436 | A * | 3/1992 | Noschese | 29/876 |
| 5,192,225 | A * | 3/1993 | Suzuki | 439/489 |
| 6,056,577 | A * | 5/2000 | Blanchet | 439/352 |
| 6,464,526 | B1 * | 10/2002 | Seufert et al. | 439/352 |
| 7,347,710 | B2 * | 3/2008 | Ohtaka et al. | 439/352 |
| 2008/0176436 | A1 | 7/2008 | Morello | |

* cited by examiner

*Primary Examiner* — Phuong Dinh
(74) *Attorney, Agent, or Firm* — Paul W. Thiede

(57) ABSTRACT

An electrical connector assembly includes a male connector, a female connector, and a sleeve. The male connector has a shoulder. The female connector is constructed to receive the male connector and has a flex arm with a nib. The sleeve is constructed to receive the female connector and has an inner surface. When the male connector, the female connector, and the sleeve are telescoped together, the inner surface of the sleeve overlaps the flex arm and forces engagement between the shoulder and the nib to eliminate relative movement between the male and female connectors.

22 Claims, 1 Drawing Sheet

ELECTRICAL CONNECTOR ASSEMBLY

FIELD OF THE INVENTION

This invention relates generally to electrical connector assemblies, and more particularly to electrical connector assemblies having male connectors and female connectors.

BACKGROUND OF THE INVENTION

Electrical connector assemblies are typically used to join electrical circuits. In the automotive industry, electrical connector assemblies are used in bussed electrical centers (BECs), engine compartments, and in other areas. In one type, a male connector and a female connector are mated together. But sometimes the connectors become unmated due to vibration and other causes.

SUMMARY OF THE INVENTION

One embodiment of the invention includes an electrical connector assembly that itself includes a male connector, a female connector, and a sleeve. The male connector has a shoulder. The female connector is constructed to receive the male connector and has a flex arm with a nib. The sleeve is constructed to receive the female connector and has an inner surface. When the male connector, the female connector, and the sleeve are telescoped together, the inner surface of the sleeve overlaps the flex arm and forces engagement between the shoulder and the nib to eliminate relative movement between the male and female connectors.

Another embodiment of the invention includes an electrical connector assembly that itself includes a plug connector, a shroud, and a sleeve. The plug connector has a ramp that extends outwardly from a wall of the plug connector. The ramp has a shoulder that is located at a trailing end of the ramp. The shroud has a cavity that receives the plug connector. The shroud has a flex arm that is defined in a wall of the shroud by one or more slots in the wall. The flex arm has an outer surface and has a nib that faces inwardly toward the cavity. The sleeve is constructed to receive the shroud and has a substantially planar inner surface. When the plug connector, the shroud, and the sleeve are telescoped together, the nib rides over the ramp. Also, the inner surface of the sleeve abuts against the outer surface of the flex arm and forces engagement between the shoulder and the nib. When the electrical connector assembly is vibrated, the forced engagement causes the plug connector and the shroud to vibrate together as a single unit.

DETAILED DESCRIPTION OF THE PREFERRED EMBODIMENTS

Referring in more detail to the drawings, FIGS. 1-5 show an exemplary embodiment of an electrical connector assembly 10 that can be used in an automotive application such as in a bussed electrical center (BEC), an engine compartment, or another area. The electrical connector assembly 10 is designed to remain mated when vibrated strongly and to ensure proper mating position between connectors of the electrical connector assembly. In the embodiment shown, the electrical connector assembly 10 includes a male connector 12, a female connector 14, and a sleeve 16.

Figure 1:
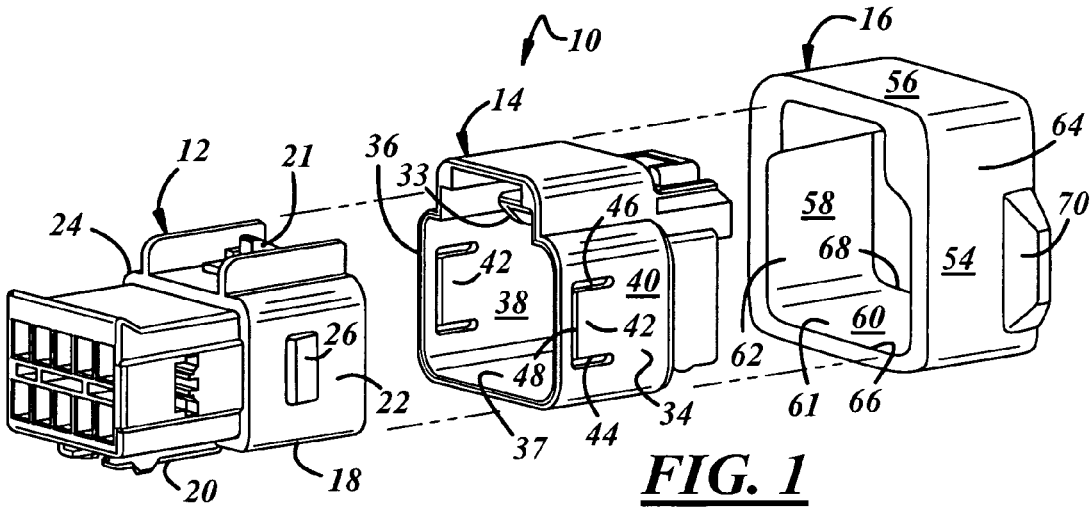
FIG. 1 is an exploded view of an exemplary embodiment of an electrical connector assembly.
Figure 4:
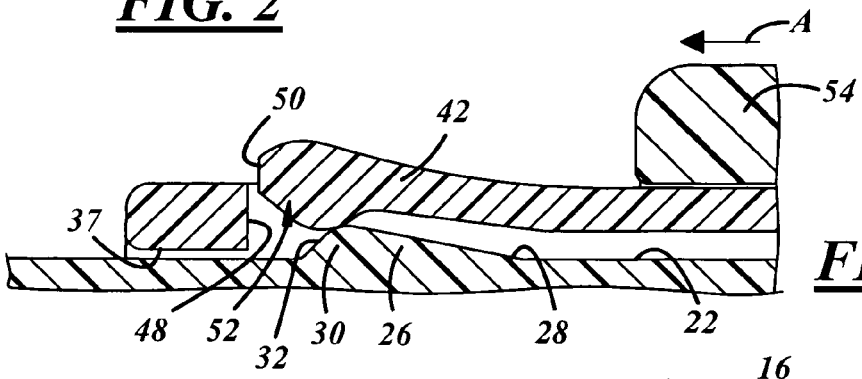
FIG. 4 is a sectional view of the electrical connector assembly of FIG. 1, showing the sleeve in the retracted position.

The male connector 12 mates with the female connector 14 and holds-in-place a number of electrical wires (not shown). The male connector 12 can have various configurations including a plug connector as shown. Referring to FIG. 1, the male connector 12 has a one-piece structure, but could have a structure of separate pieces including a housing 18 and a body 20 that are attached together. Though not shown, the housing 18 has a hollow interior for receiving a part of the female connector 14. The male connector also has a primary locking structure 21 extending from a top wall thereof. The male connector 12 has a generally rectangular shape with a first side wall 22 and a second side wall 24. Each side wall has a ramp 26 positioned opposite each other (only ramp on first side wall shown). Referring to FIG. 4, the ramp 26 has a rigid body that extends outwardly from the first side wall 22. The ramp 26 is slanted outwardly from a leading end 28 to a trailing end 30. A shoulder 32 is an angled surface located at the trailing end 30. In other embodiments, the shoulder 32 could be other surfaces including a surface located on an edge of the male connector 12, and not necessarily a surface located on the ramp 26.

The female connector 14 receives the male connector 12 and locks therewith. The female connector 14 can have various configurations including that of a shroud as shown. Referring to FIG. 1, the female connector 14 has a somewhat complementary shape to that of the male connector 12, in this case a generally rectangular one-piece structure. The female connector 14 has a primary locking structure 33 that locks with the structure 21 of the male connector 12, though leaves a bit of play or looseness between the connectors. The female connector 14 is constructed of a first side wall 34 and an opposing second side wall 36, and has a cavity 37 with an inner surface 38 and has an outer surface 40. The female connector 14 also has a flex arm 42 located on each side wall and oppositely positioned with respect to each other. Though not shown, the female connector 14 has an inner structure that is inserted into the hollowed interior of the housing 18 when the male and female connectors are telescoped together.

Figure 2:
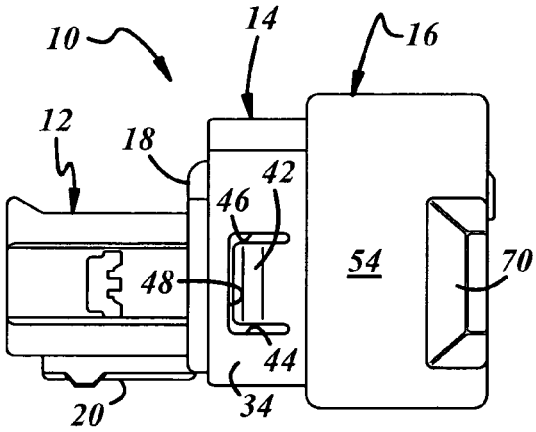
FIG. 2 is a side view of the electrical connector assembly of FIG. 1, showing a sleeve in a retracted position.

Taking a single flex arm as an example, the flex arm 42 can bend inwardly and outwardly with respect to the first side wall 34 and the cavity 37, and is defined in the first side wall by a first, second, and third slot 44, 46, and 48. Referring to FIG. 2, the first and second slots 44 and 46 are elongated and parallel to each other, and the third slot 48 is elongated and extends perpendicularly between and intersects the first and second slots. Referring to FIG. 4, the flex arm 42 terminates at a free end 50 and has a nib 52 located near the free end. The nib 52 can be an extremity of various shapes, such as a rounded protrusion as shown. The nib 52 faces and extends inwardly toward the cavity 37. In other embodiments, the flex arm 42 could be defined by a pair of slots that are angled toward each other and converge at an intersection. In still other embodiments, the flex arm 42 could be defined by two parallel slots that are spaced apart and that do not intersect; here, the flex arm would not have a free end but would still bulge inwardly and outwardly.

The sleeve 16 receives the female connector 14 and helps maintain mating between the male connector 12 and the female connector during strong vibrations exerted on the electrical connector assembly 10 by reducing or altogether eliminating relative movement between the connectors. The sleeve 16 also helps lock and ensure proper positioning between the male and female connectors 12 and 14. The sleeve 16 can have different configurations that will depend on, among other things, the particular configuration of the female connector 14. Referring to FIG. 1, the sleeve 16 has a somewhat complementary shape to that of the female connector 14, in this case a generally rectangular one-piece structure. As a general matter, the sleeve 16 is shaped to receive and slide back and forth over at least a part of the female connector 14. The sleeve 16 has a four-sided perimeter with a first side wall 54, a top wall 56, a second side wall 58, and a bottom wall 60. The walls define a cavity 61 with an inner surface 62 and an outer surface 64. Each wall is mostly, if not substantially, planar in a direction from a leading end 66 and to a trailing end 68 of the sleeve 16. The sleeve 16 also has a pair of oppositely disposed handles 70 protruding from the outer surface 64. The handles 70 are used to move the sleeve 16 in relation to the female connector 14.

As an option, one or more seals are used in the electrical connector assembly 10 to protect against moisture, dust, and other contaminants, and, in some cases, to help dampen vibrations. For example, a peripheral seal can be sandwiched between the male connector 12 and female connector 14, and can be positioned between an inner surface of the housing 18 and an outer surface of the inner structure. Here, in use, the sleeve 16 would squeeze the seal between the inner and outer surfaces.

In use, the electrical connector assembly 10 maintains mating between the male and female connectors 12 and 14 during vibrations, and properly positions the male and female connectors with respect to each other. Relative movement between the male and female connectors 12 and 14, which may otherwise occur due to vibrations exerted on the electrical connector assembly 10, is reduced or substantially eliminated by forced engagement caused by the sleeve 16. When assembled, the male connector 12, the female connector 14, and the sleeve 16 are telescoped together in an overlapping manner such that all sides of the male connector are completely surrounded by the female connector and all sides of the female connector are completely surrounded by the sleeve.

Figure 3:
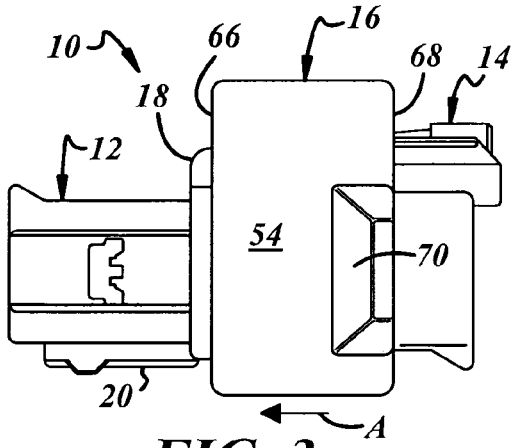
FIG. 3 is a side view of the electrical connector assembly of FIG. 1, showing the sleeve in a forward position.
Figure 5:
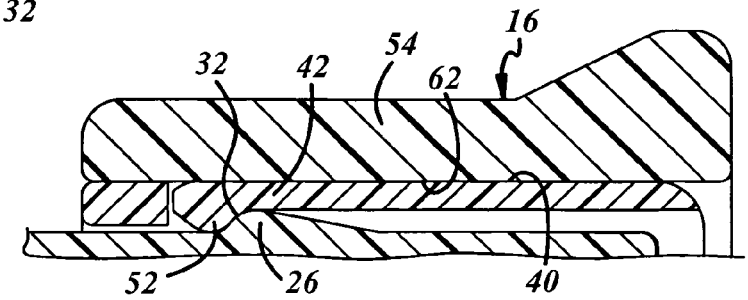
FIG. 5 is a sectional view of the electrical connector assembly of FIG. 1, showing the sleeve in the forward position.

Referring to FIG. 2, the male and female connectors 12 and 14 are mated together, and the sleeve 16 is in a retracted position where it surrounds a rearward end of the female connector. Referring now to FIG. 4, in the retracted position and when the female connector 14 is telescoped over the male connector 12, the nib 52 rides over the ramp 26 and contacts the shoulder 32. Referring to FIG. 3, the sleeve 16 is moved in a forward direction A over the female connector 14 to a forward position. The sleeve 16 brings the nib 52 into forced engagement with the shoulder 32. Referring now to FIG. 5, in the forward position, the sleeve 16 overlaps the flex arm 42 and the ramp 26, and forces abutment between the nib 52 and the shoulder 32 by pressing the flex arm toward the ramp. The inner surface 62 abuts and lies flush against the outer surface 40, including the outer surface of the flex arm 42. The sleeve 16 remains in the forward position due in part to a press-fit between the sleeve and the female connector 14 and/or due to an opposing force exerting outwardly from the flex arm 42 to the inner surface 62. The forced engagement eliminates the primary lock looseness and causes the male and female connectors 12, 14 to act as a single unit when subjected to vibrations. In other words, the electrical connector assembly 10 vibrates as if it were a single piece, and no relative vibrations exist between the male connector 12, the female connector 14, and the sleeve 16 so that the connectors do not come unmated which might otherwise occur.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical connector assembly comprising:

a male connector having shoulders;

a female connector receiving the male connector and having opposing flex arms disposed on opposing lateral side walls of the female connector and the opposing flex arms have corresponding nibs; and a sleeve receiving the female connector and having an inner surface, wherein the male connector, the female connector, and the sleeve are telescoped together such that the inner surface of the sleeve engages the opposing flex arms and forces locking engagement between the respective shoulders and the respective nibs to eliminate relative movement between the male and the female connector, and wherein the male connector comprises rigid inclined ramps extending from an external surface of a wall of the male connector in a direction outwardly away from the male connector to face an inner surface of the female connector when the male connector, the female connector, and the sleeve are telescoped together, and the respective shoulders are located adjacent a trailing end of the respective rigid inclined ramps.

2. The electrical connector assembly of claim 1 wherein the flex arms are is located in a wall of the female connector and the respective flex arms are defined by at least a pair of slots in the wall.

3. The electrical connector assembly of claim 2 wherein the female connector has a cavity that receives the male connector and the nibs are inwardly facing toward the cavity.

4. The electrical connector assembly of claim 1 wherein the inner surface of the sleeve is substantially planar from a leading end of the sleeve to a trailing end of the sleeve.

5. The electrical connector assembly of claim 1 wherein an inner surface of the sleeve abuts generally flush with an outer surface of the female connector on all sides when the male connector, the female connector, and the sleeve are telescoped together and the sleeve overlaps the shoulders and the nibs.

6. The electrical connector assembly of claim 1 wherein, when the male connector, the female connector, and the sleeve are telescoped together and the sleeve overlaps the shoulders and the nibs, an outer surface of the flex arms abuts flush against the inner surface of the sleeve.

7. The electrical connector assembly of claim 1 wherein when the male connector, the female connector, and the sleeve are telescoped together and the sleeve overlaps the shoulders and the nibs, and at least a portion of the electrical connector assembly is vibrated, the male and the female connector vibrate together as a single unit.

8. The electrical connector assembly of claim 1, wherein when the sleeve overlaps the shoulders and the nibs, the sleeve maintains the locking engagement by forcing abutment of the respective nib against the respective shoulder.

9. The electrical connector assembly of claim 1, wherein the female connector receives inclined ramps of the male connector, and the respective nib rides over the respective inclined ramp before the sleeve is telescoped over the female connector to ensure the locking engagement between the shoulders of the male connector and the nibs of the female connector.

10. An electrical connector assembly comprising:

a plug connector having ramps disposed on and extending from an exterior surface of a wall of the plug connector in a direction outwardly away from the plug connector, the ramps having a respective shoulder located at a trailing end of the ramps;

a shroud having a cavity configured to receive the ramps and the shoulders of the plug connector within the cavity, said shroud further having opposing flex arms disposed on opposing lateral side walls of the shroud, the respective flex arms being defined in a wall of the shroud by at least a pair of slots and having an outer surface;

nibs facing inwardly toward the cavity; and a sleeve receiving the shroud and having a substantially planar inner surface, wherein the plug connector, the shroud, and the sleeve are telescoped together such that the respective nibs rides over the ramps that face an inner surface of the female connector and the inner surface of the sleeve engages the flex arms and abuts against the outer surface of the flex arms and forces locking engagement between the shoulders and the nibs such that when the assembly is vibrated, the plug connector and the shroud vibrate together as a single unit.

11. The electrical connector assembly of claim 10 wherein the plug connector has a pair of oppositely positioned inclined ramps and the sleeve has a pair of oppositely positioned planar inner surfaces.

12. The electrical connector assembly of claim 10 wherein, when the plug connector, the shroud, and the sleeve are telescoped together and the sleeve overlaps the shoulders and the nibs, the shroud surrounds the plug connector on all sides, and the sleeve surrounds the shroud on all sides, and the inner surface of the sleeve abuts an outer surface of the shroud.

13. The electrical connector assembly of claim 10 wherein the inner surface of the sleeve lies flush against the outer surface of the flex arms when the plug connector, the shroud, and the sleeve are telescoped together and the sleeve overlaps the shoulders and the nibs.

14. The electrical connector assembly of claim 10, wherein when the sleeve overlaps the shoulders and the nibs, the sleeve maintains the locking engagement by forcing abutment of the respective nib against the respective shoulder.

15. The electrical connector assembly of claim 10, wherein the shroud receives inclined ramps of the plug connector, and the respective nib rides over the respective inclined ramp before the sleeve is telescoped over the shroud to ensure the locking engagement between the shoulders of the plug connector and the nibs of the shroud.

16. An electrical connector assembly comprising:

a female connector including a nib disposed on a flex arm and configured to receive a male connector;

the male connector including a shoulder disposed on a trailing end of a rigid inclined ramp extending from an external surface of a wall of the male connector in a direction outwardly away from the male connector; and a sleeve, wherein the male connector is axially lockingly engaging with the female connector such that the nib on the flex arm is in communication with the rigid inclined ramp and the shoulder wherein the rigid inclined ramp faces an inner surface of the female connector when the male and the female connector are lockingly engaged, and the sleeve being axially displaced to advance abuttingly against the flex arm as the sleeve moves towards the nib with respect to the lockingly engaged male and the female connector and ensure locking engagement of the nib with the shoulder when an inner surface of the sleeve abuttingly engages an end of the flex arm opposite the nib, said sleeve further overlying the shoulder and the nib of the lockingly engaged male and the female connector so as to prevent displacement of the shoulder and the nib such that relative movement between the male and the female connector does not occur.

17. The electrical connector assembly of claim 16, wherein the female connector comprises an outer surface, and a substantial portion of the inner surface abuts a substantial portion of the outer surface when the sleeve overlies the shoulder and the nib, and an outer surface of the flex arm substantially abuts the inner surface of the sleeve when the sleeve overlies the shoulder and the nib.

18. The electrical connector assembly of claim 16 wherein said locking engagement includes where the nib engagingly abuts the shoulder and an outer surface of the of the male connector adjacent the shoulder.

19. The electrical connector assembly of claim 16 wherein said locking engagement further includes a force being exerted outwardly away from the male connector through the nib against an outer surface of the flex arm such that the outer surface presses against, and engagingly abuts the inner surface of the sleeve.

20. The electrical connector assembly of claim 16 wherein the locking engagement of the nib and the shoulder is used to eliminate relative movement between the male and the female connector and a primary locking structure is configured to substantially secure the male and the female connector together.

21. A method of assembling an electrical connector assembly, comprising:

lockingly engaging a male connector received within a female connector, and the female connector includes opposing flex arms having corresponding nibs that are in communication with opposing inclined ramps and shoulders disposed on the male connector, wherein the opposing flex arms are disposed on opposing lateral side walls of the female connector and the inclined ramps extend from an external surface of the male connector in a direction outwardly away from the male connector to face an inner surface of the female connector when the male and the female connector are lockingly engaged; and displacing a sleeve received by the female connector and configured to engage the opposing flex arms to ensure locking engagement of the respective nib with the respective shoulder after the step of lockingly engaging the male connector received in the female connector, said sleeve is further configured to overlie the respective shoulder and the respective nib so as to prevent displacement of the shoulders and the nibs such that relative movement between the male and the female connector does not occur.

22. The method of claim 21, wherein the step of displacing the sleeve further includes the sleeve having an inner surface and the female connector having an outer surface, and a substantial portion of the inner surface abuts a substantial portion of the outer surface when the sleeve overlies the respective shoulder and the respective nib, and an outer surface of the flex arms substantially abuts the inner surface of the sleeve when the sleeve overlies the shoulders and the nibs.

* * * * *